US011346343B2

(12) United States Patent
Suzuki et al.

(10) Patent No.: US 11,346,343 B2
(45) **Date of Patent: *May 31, 2022**

(54) VANE PUMP INCLUDING PRESSURE RELIEF GROOVE

(71) Applicants: TAIHO KOGYO Co., Ltd., Toyota (JP); TOYOTA JIDOSHA KABUSHIKI KAISHA, Toyota (JP)

(72) Inventors: Yuji Suzuki, Toyota (JP); Akihiro Uto, Toyota (JP); Naoyuki Miyara, Nagoya (JP); Hiroki Hara, Nagoya (JP); Shinsuke Kiyomiya, Seto (JP); Akira Fujii, Toyota (JP)

(73) Assignees: TAIHO KOGYO Co., Ltd., Toyota (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 296 days.

This patent is subject to a terminal disclaimer.

(21) Appl. No.: 16/346,988

(22) PCT Filed: Oct. 30, 2017

(86) PCT No.: PCT/JP2017/039087
§ 371 (c)(1),
(2) Date: May 2, 2019

(87) PCT Pub. No.: WO2018/084105
PCT Pub. Date: Nov. 5, 2018

(65) Prior Publication Data

US 2020/0056611 A1 Feb. 20, 2020

(30) Foreign Application Priority Data

Nov. 3, 2016 (JP) ..... JP2016-215731

(51) Int. Cl.
*F04C 18/344* (2006.01)
*F04C 25/02* (2006.01)
*F04C 29/12* (2006.01)

(52) U.S. Cl.
CPC ..... *F04C 18/344* (2013.01); *F04C 18/3441* (2013.01); *F04C 25/02* (2013.01);
(Continued)

(58) Field of Classification Search
CPC ..... F04C 18/344; F04C 25/02; F04C 18/356; F04C 29/12; F04C 29/128; F04C 2240/20;
(Continued)

(56) References Cited

U.S. PATENT DOCUMENTS 3,824,040 A 7/1974 Aronson
5,823,755 A 10/1998 Wilson et al.
(Continued)

FOREIGN PATENT DOCUMENTS

CN 101657644 A 2/2010
CN 204267291 U 4/2015
(Continued)

OTHER PUBLICATIONS

Office Action dated Apr. 8, 2021 in co-pending U.S. Appl. No. 16/345,972, 11 pages.
(Continued)

*Primary Examiner* — Mary Davis
*Assistant Examiner* — Paul W Thiede
(74) *Attorney, Agent, or Firm* — Oblon, McClelland, Maier & Neustadt, L.L.P.

(57) ABSTRACT

A vane pump including a housing having a peripheral wall portion, a bottom wall portion, and a pump chamber; a rotor disposed in the pump chamber to be rotatable; a vane disposed to be slidable in the radial direction with respect to
(Continued)

the rotor and partitioning the pump chamber into working chambers; and a reed valve that opens and closes a discharge hole of the bottom wall portion. A pressure relief groove is disposed in a portion of the bottom wall portion corresponding to the discharge section with a clearance secured between the peripheral wall portion and the pressure relief groove. When the vane overlaps the pressure relief groove, a pair of the working chambers on both sides of the vane in the rotational direction communicates with each other via the pressure relief groove.

3 Claims, 8 Drawing Sheets

(52) U.S. Cl.
CPC ..... *F04C 29/12* (2013.01); *F04C 29/128* (2013.01); *F04C 2240/20* (2013.01); *F04C 2240/30* (2013.01)

(58) Field of Classification Search
CPC . F04C 2240/30; F04C 18/3441; F04C 18/358
See application file for complete search history.

(56) References Cited

U.S. PATENT DOCUMENTS

| | | | | |
|---|---|---|---|---|
| 7,014,439 | B2 | 3/2006 | Kano et al. | |
| 2010/0092323 | A1 | 4/2010 | Ohtahara et al. | |
| 2015/0330389 | A1 | 11/2015 | Nakagawa | |
| 2016/0208802 | A1 | 7/2016 | Yamazaki | |
| 2017/0276133 | A1 | 9/2017 | Yoshida | |
| 2019/0271313 | A1* | 9/2019 | Suzuki ..... | F04C 29/12 |
| 2020/0056611 | A1 | 2/2020 | Suzuki et al. | |

FOREIGN PATENT DOCUMENTS

| | | | |
|---|---|---|---|
| DE | 36 19 167 | A1 | 1/1987 |
| DE | 40 19 854 | A1 | 1/1991 |
| DE | 10 2004 003 567 | A1 | 9/2004 |
| DE | 10 2007 010 729 | B3 | 4/2008 |
| EP | 1 890 040 | B1 | 6/2012 |
| JP | 2002-70774 | A | 3/2002 |
| JP | 2004-263690 | A | 9/2004 |
| JP | 2004-285978 | A | 10/2004 |
| JP | 2008-82262 | A | 4/2006 |
| JP | 2007-138842 | A | 6/2007 |
| JP | 2010-163875 | A | 7/2010 |
| WO | WO 2008/080492 | A1 | 7/2008 |
| WO | WO 2010/031504 | A2 | 3/2010 |

OTHER PUBLICATIONS

Indian Office Action dated Dec. 8, 2020 in Indian Patent Application No. 201917021550, 7 pages.
Extended European Search Report dated Aug. 19, 2019, in Patent Application No. 17867544.3, 9 pages.
Combined Chinese Office Action and Search Report dated Jun. 12, 2020 in Chinese Patent Application No. 201780066233.3 (with English translation), 12 pages.
European Office Action dated Aug. 13, 2020 in European Patent Application No. 17 867 544.3, 4 pages.
International Search Report dated Dec. 26, 2017 in PCT/JP2017/039087 (with English translation), 3 pages.
International Preliminary Report on Patentability and Written Opinion of the International Searching Authority dated May 16, 2019 in PCT/JP2017/039087 filed Oct. 30, 2017 (with English translation), 13 pages.
Notification of Reasons for Refusal dated Nov. 13, 2018 in Japanese Patent Application No. 2016-215731, (with English translation), 6 pages.
Notification of Reasons for Refusal dated May 14, 2019 in Japanese Patent Application No. 2016-215731, (with English translation), 6 pages.
Combined Chinese Office Action and Search Report dated Nov. 22, 2019, in Patent Application No. 201780066233.3 (with English translation), 10 pages.

* cited by examiner

VANE PUMP INCLUDING PRESSURE RELIEF GROOVE

TECHNICAL FIELD

The present invention relates to a vane pump driven by an engine or the like of a vehicle, for example.

BACKGROUND ART

A pump chamber is defined inside a housing of a vane pump (see Patent Documents 1 and 2, for example). The pump chamber is divided into a plurality of working chambers by a vane that is rotatable. The pump chamber houses air and lubricating oil. A discharge hole is provided to open in a bottom wall portion of the housing. The discharge hole is covered by a reed valve so as to be openable/closable. The reed valve is switched from a valve-closed state to a valve-open state by an internal pressure of the pump chamber.

PRIOR-ART DOCUMENTS

Patent Documents

[Patent Document 1] European Patent No. 1890040
[Patent Document 2] WO 2010/031504

SUMMARY OF THE INVENTION

Problem to be Solved by the Invention

In the valve-closed state, however, the valve tends to stick to a valve seat (periphery of the discharge hole) because of the rigidity of the valve itself or an oil film (film of lubricating oil) interposed between the valve and the valve seat, for example. Therefore, when the valve is open, the valve is abruptly moved away from the valve seat after air in the pump chamber is compressed and the internal pressure of the pump chamber is raised to a degree. Thus, the reed valve opens abruptly.

In order to suppress abrupt valve opening, it is only necessary to lower the internal pressure of the pump chamber during valve opening. In this respect, the vane pumps according to Patent Documents 1 and 2 include a recessed portion provided in the inner surface of a bottom wall portion of the housing to communicate with the discharge hole. Therefore, the internal pressure of the pump chamber can be lowered to a degree corresponding to the capacity of the recessed portion. In the vane pumps according to Patent Documents 1 and 2, however, the recessed portion is disposed along, or in other words in abutment with, the inner peripheral surface of a peripheral wall portion of the housing. Lubricating oil tends to be accumulated around the inner peripheral surface because of a centrifugal force generated during rotation of the vane. In the vane pumps according to Patent Documents 1 and 2, in addition, the recessed portion is disposed near the lower end portion of the pump chamber. Lubricating oil tends to be accumulated around the lower end portion because of the weight of the lubricating oil itself. In the vane pumps according to Patent Documents 1 and 2, further, the recessed portion is small in width in the circumferential direction (rotational direction of the vane). Therefore, a pair of working chambers on both sides of the vane in the rotational direction do not communicate with each other via the recessed portion even if the vane which is rotating overlaps the recessed portion. Thus, lubricating oil accumulated in the recessed portion is not easily discharged.

In the vane pumps according to Patent Documents 1 and 2, as described above, lubricating oil which is an incompressible fluid tends to be accumulated in the recessed portion. Therefore, it is difficult to lower the internal pressure of the pump chamber. Thus, it is difficult to suppress abrupt opening of the reed valve. Thus, it is an object of the present invention to provide a vane pump in which abrupt opening of a reed valve can be suppressed.

Means for Solving the Problem

In order to solve the above problem, the present invention provides a vane pump including: a housing that has a tubular peripheral wall portion and a bottom wall portion which is disposed at one end of the peripheral wall portion in an axial direction and in which a discharge hole is provided to open, and that defines a pump chamber communicating with the discharge hole inside the housing; a rotor that is disposed in the pump chamber and that is rotatable about an axis of the rotor; a vane disposed so as to be slidable with respect to the rotor in a radial direction, the vane partitioning the pump chamber into a plurality of working chambers and causing capacities of the working chambers to increase and decrease along with rotation of the rotor; and a reed valve that opens and closes the discharge hole to allow a compressible fluid compressed in the working chambers and an incompressible fluid to be discharged intermittently. The vane pump is characterized in that: a position at which a sliding direction of the vane with respect to the rotor is inverted from outward in the radial direction to inward in the radial direction during forward rotation of the rotor is defined as a reference position; a section of the pump chamber on a side of the discharge hole with respect to the reference position is defined as a discharge section; a pressure relief groove is disposed in a portion of an inner surface of the bottom wall portion corresponding to the discharge section with a clearance secured between an inner surface of the peripheral wall portion and the pressure relief groove; and a pair of the working chambers on both sides of the vane in a rotational direction communicate with each other via the pressure relief groove when the vane overlaps the pressure relief groove during forward rotation of the rotor. The "form in which a pressure relief groove is disposed" in a portion corresponding to the discharge section includes a form in which "the entirety" of the pressure relief groove is disposed in the portion corresponding to the discharge section, and a form in which "a part" of the pressure relief groove is disposed in the portion corresponding to the discharge section.

Effect of the Invention

Hereinafter, leakage of a part of a working fluid from the high pressure side to the low pressure side between a pair of working chambers that are adjacent to each other across the vane will be referred to as "internal leakage" as appropriate. With the vane pump according to the present invention, a pair of working chambers on both sides of the vane in the rotational direction communicate with each other via the pressure relief groove, while bypassing the vane, when the vane overlaps the pressure relief groove during forward rotation of the rotor. Therefore, a part of the working fluid can be caused to internally leak from the working chamber on the front side in the rotational direction (high pressure side) to the working chamber on the rear side in the rotational direction (low pressure side). Thus, the amount of the working fluid in the working chamber on the front side in the rotational direction can be reduced. In other words, an excessive rise in internal pressure of the working chamber on the front side in the rotational direction can be suppressed. Hence, with the vane pump according to the present invention, abrupt opening of the reed valve can be suppressed.

MODES FOR CARRYING OUT THE INVENTION

A vane pump according to an embodiment of the present invention will be described below.

First Embodiment

Figure 1:
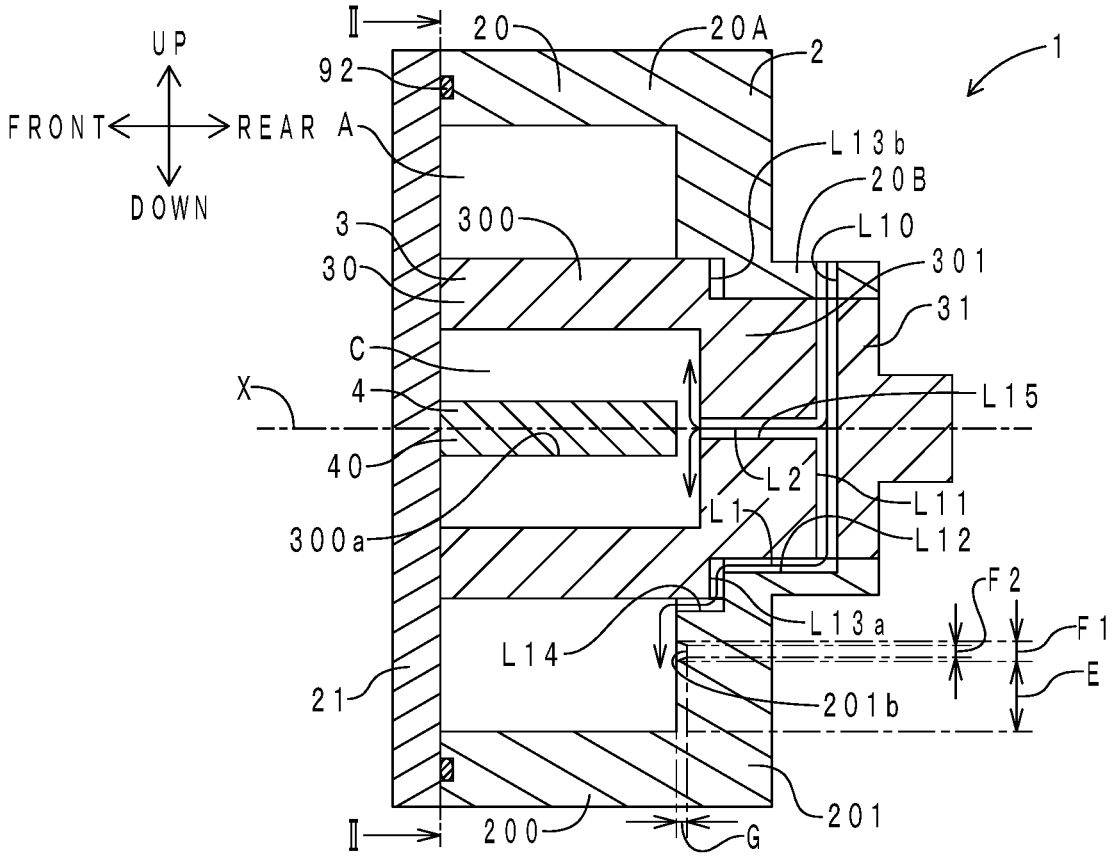
FIG. 1 is an axial sectional view of a vane pump according to a first embodiment.
Figure 2:
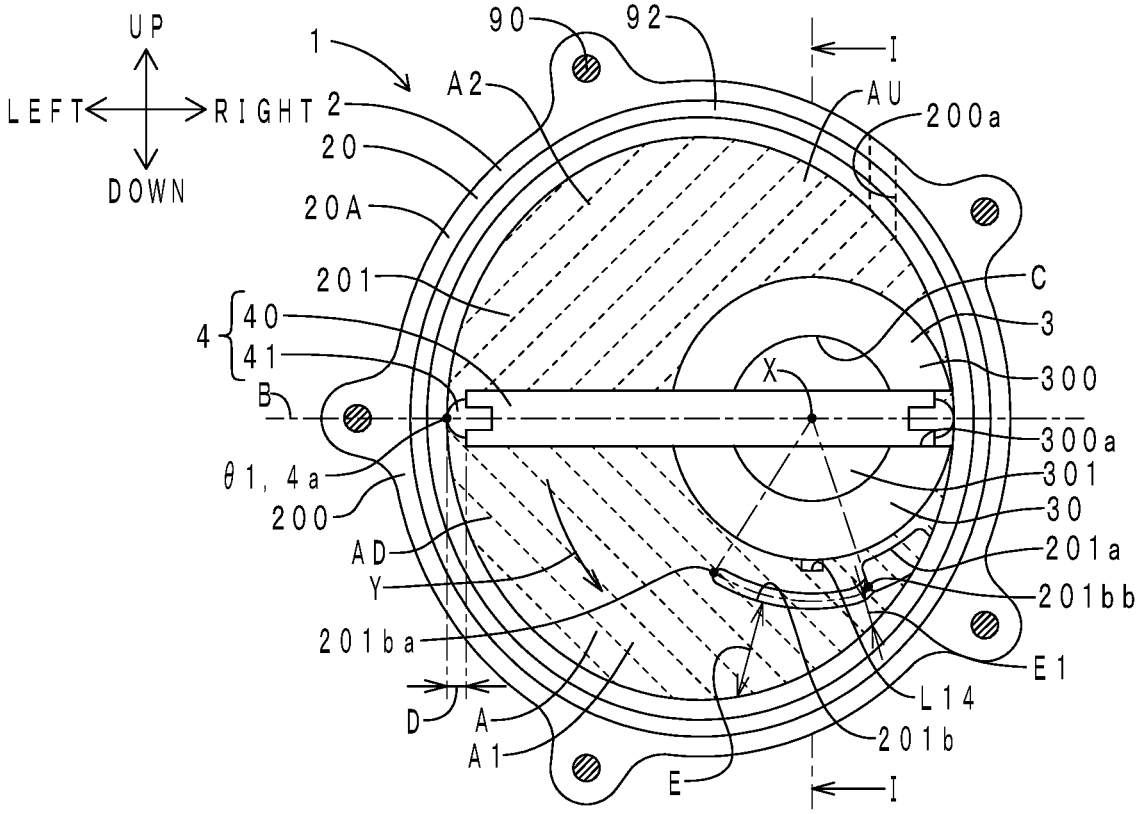
FIG. 2 is a cross-sectional view taken along the II-II direction of FIG. 1.
Figure 3:
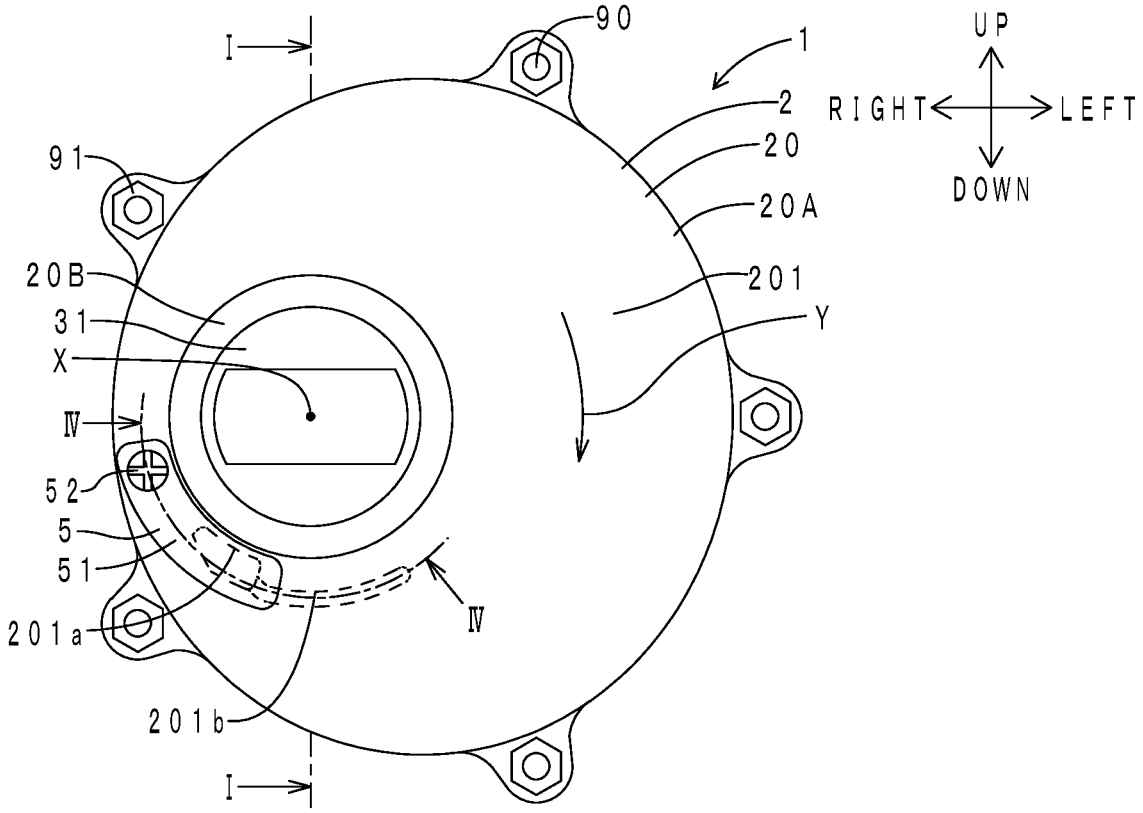
FIG. 3 is a rear view of the vane pump.

In the following drawings, the front-rear direction corresponds to the "axial direction" according to the present invention. FIG. 1 is an axial sectional view of a vane pump according to the present embodiment. FIG. 2 is a cross-sectional view taken along the II-II direction of FIG. 1. FIG. 3 is a rear view of the vane pump. FIG. 1 corresponds to a section taken along the I-I direction of FIGS. 2 and 3.

[Configuration of Vane Pump]

First, the configuration of the vane pump according to the present embodiment will be described. A vane pump 1 is a negative pressure source for a brake booster (not illustrated) of a vehicle. As illustrated in FIGS. 1 to 3, the vane pump 1 includes a housing 2, a rotor 3, a vane 4, a reed valve (check valve) 5, and oil passages L1 and L2.

(Housing 2)

The housing 2 is fixed to a chain cover (not illustrated) of an engine. The housing 2 includes a housing body 20 and an end plate 21. The housing body 20 includes a pump portion 20A and a tubular portion 20B. The pump portion 20A has the shape of a bottomed elliptical cylinder that opens toward the front side. The pump portion 20A includes a peripheral wall portion 200 and a bottom wall portion 201. A pump chamber A is defined inside the pump portion 20A. As discussed later, the pump chamber A is divided into a suction section AU and a discharge section AD.

The peripheral wall portion 200 has the shape of an elliptical tube that extends in the front-rear direction. As illustrated in FIG. 2, a suction hole 200*a* is provided to open in the upper portion of the peripheral wall portion 200. The outlet of the suction hole 200*a* opens in the pump chamber A. Meanwhile, the inlet of the suction hole 200*a* is coupled to the brake booster via a suction passage (not illustrated). A check valve (not illustrated) is disposed in the suction passage to permit air (working fluid) to flow in only one direction (from the brake booster toward the pump chamber A). The bottom wall portion 201 is disposed at the rear end (one end in the axial direction) of the peripheral wall portion 200. As illustrated in FIG. 2, a discharge hole 201*a* and a pressure relief groove 201*b* are disposed in the bottom wall portion 201. The discharge hole 201*a* penetrates the bottom wall portion 201 in the front-rear direction. The discharge hole 201*a* is openable/closable by the reed valve 5. The discharge hole 201*a* is continuous with a through hole (not illustrated) provided to open in the chain cover. Therefore, the pump chamber A communicates with an internal space of the chain cover via the discharge hole 201*a*, the reed valve 5, and the through hole. The pressure relief groove 201*b* will be described in detail later.

The tubular portion 20B has the shape of a cylinder that extends in the front-rear direction. The tubular portion 20B is continuous with the rear side of the bottom wall portion 201. The tubular portion 20B is inserted into the through hole of the chain cover. The front end of the tubular portion 20B opens in the front surface of the bottom wall portion 201.

The end plate 21 seals the peripheral wall portion 200 from the front side. An O-ring 92 is interposed between the end plate 21 and the peripheral wall portion 200. As illustrated in FIGS. 2 and 3, the end plate 21 is fixed to the peripheral wall portion 200 by a plurality of bolts 90 and a plurality of nuts 91.

(Rotor 3)

The rotor 3 includes a rotor body 30 and a shaft portion 31. The rotor body 30 has the shape of a bottomed cylinder that opens toward the front side. The rotor body 30 includes a peripheral wall portion 300 and a bottom wall portion 301. An in-cylinder space C is defined inside the rotor body 30. The peripheral wall portion 300 has the shape of a cylinder that extends in the front-rear direction. The peripheral wall portion 300 is housed in the pump chamber A. As illustrated in FIG. 2, a part of the outer peripheral surface of the peripheral wall portion 300 abuts against a part of the inner peripheral surface of the peripheral wall portion 200 in a portion between the suction hole 200*a* and the discharge hole 201*a*. The peripheral wall portion 300 is eccentric with respect to the peripheral wall portion 200. The front end surface of the peripheral wall portion 300 is in sliding contact with the rear surface (inner surface) of the end plate 21. The peripheral wall portion 300 includes a pair of rotor grooves 300*a*. The pair of rotor grooves 300*a* are disposed to face each other in a diametrical direction (in the direction of a diameter about a rotational axis X of the rotor 3), that is, to face each other at intervals of 180°. The pair of rotor grooves 300*a* penetrate the peripheral wall portion 300 in the diametrical direction. As illustrated in FIG. 1, the bottom wall portion 301 seals an opening of the peripheral wall portion 300 on the rear end side.

The shaft portion 31 extends on the rear side of the bottom wall portion 301. The shaft portion 31 is coupled to a camshaft (not illustrated) of the engine via a coupling (not illustrated). The shaft portion 31 is rotatable about the axis of the shaft portion 31 itself. That is, the rotor 3 is rotatable about the rotational axis X in a forward rotation direction Y (counterclockwise in FIG. 2 and clockwise in FIG. 3).

(Vane 4)

As illustrated in FIG. 2, the vane 4 includes a vane body 40 and a pair of caps 41. The vane body 40 has the shape of a rectangular plate. The pair of caps 41 are disposed at both ends of the vane body 40 in the longitudinal direction. The vane 4 is housed in the pump chamber A. The vane 4 is rotatable together with the rotor 3. The vane 4 is reciprocally movable in the diametrical direction along the pair of rotor grooves 300*a*. The vane 4 can divide the pump chamber A into a plurality of working chambers A1 and A2 in accordance with the rotational angle. As illustrated in FIG. 2, the pair of caps 41 are each in sliding contact with the inner peripheral surface of the peripheral wall portion 300. As illustrated in FIG. 1, the front end surface of the vane 4 is in sliding contact with the rear surface of the end plate 21. The rear end surface of the vane 4 is in sliding contact with the front surface of the bottom wall portion 201.

(Reed Valve 5)

Figure 4:
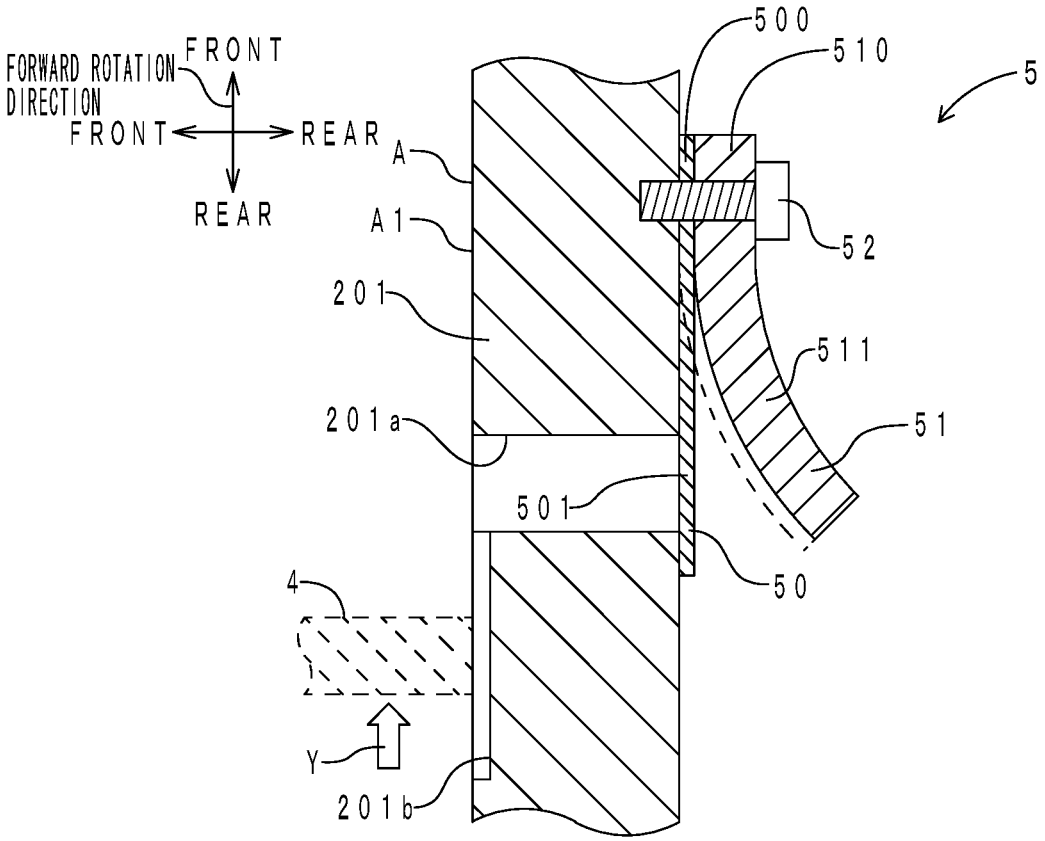
FIG. 4 is a sectional view taken along the IV-IV direction of FIG. 3.

FIG. 4 is a sectional view taken along the IV-IV direction of FIG. 3. The reed valve 5 is housed in the through hole of the chain cover. As illustrated in FIGS. 3 and 4, the reed valve 5 includes a valve (valve reed valve) 50, a stopper (stopper reed valve) 51, and a bolt (fastening member) 52. The valve 50 is disposed on the rear surface (outer surface) of the bottom wall portion 201. The valve 50 includes a fixed portion 500 and a free portion 501. The fixed portion 500 is fixed to the bottom wall portion 201 by the bolt 52. The free portion 501 is elastically deformable toward the rear side (outer side) in a cantilever manner. The stopper 51 is disposed on the rear side of the valve 50. The stopper 51 includes a fixed portion 510 and a restriction portion 511. The fixed portion 510 is fixed to the bottom wall portion 201 by the bolt 52 in the state of overlapping the fixed portion 500 of the valve 50. The restriction portion 511 is located on the rear side away from the bottom wall portion 201.

The valve 50 is switchable between a valve-closed state indicated by the solid line in FIG. 4 and a valve-open state indicated by the dotted line in FIG. 4. Therefore, the reed valve 5 can open the discharge hole 201*a* intermittently. Thus, the air tightness of the pump chamber A can be improved compared to a case where the reed valve 5 is not disposed in the vane pump 1. In addition, the performance to hold lubricating oil can be improved. In the valve-closed state, the free portion 501 of the valve 50 is seated on the valve seat (periphery of the discharge hole 201*a*). The free portion 501 of the valve 50 seals the discharge hole 201*a*. In the valve-open state, on the other hand, the free portion 501 of the valve 50 is moved toward the rear side away from the valve seat. The free portion 501 of the valve 50 abuts against the restriction portion 511 of the stopper 51.

(Oil Passages L1 and L2)

The oil passage L1 is disposed between an oil passage (not illustrated) on the engine side and the pump chamber A. As illustrated in FIG. 1, the oil passage L1 includes, from the upstream side toward the downstream side: an oil hole L10 that penetrates the tubular portion 20B in the radial direction; an oil hole L11 that penetrates the shaft portion 31 in the diametrical direction; an oil groove L12 provided to be recessed in the inner peripheral surface of the tubular portion 20B and extending in the front-rear direction; a pair of oil grooves L13*a* and L13*b* provided to be recessed in the rear surface of the bottom wall portion 301 and extending in the radial direction; and an oil groove L14 provided to be recessed in the inner peripheral surface of the front end of the tubular portion 20B and extending in the front-rear direction. Lubricating oil is intermittently supplied to the pump chamber A via the oil passage L1.

The oil passage L2 is disposed between the oil passage on the engine side and the in-cylinder space C. The oil passage L2 includes, from the upstream side toward the downstream side, the oil hole L10, the oil hole L11, and an oil hole L15 branched from the oil hole L11 and extending in the front-rear direction. Lubricating oil is intermittently supplied to the in-cylinder space C via the oil passage L2.

Lubricating oil supplied to the pump chamber A and the in-cylinder space C via the oil passages L1 and L2 lubricates various sliding portions (such as a sliding interface between the vane 4 and the peripheral wall portion 200, a sliding interface between the vane 4 and the end plate 21, a sliding interface between the vane 4 and the bottom wall portion 201, a sliding interface between the rotor 3 and the end plate 21, a sliding interface between the rotor 3 and the bottom wall portion 201, and a sliding interface between the vane 4 and the rotor groove 300*a*, for example). Lubricating oil tends to flow downward because of the weight of the lubricating oil itself. In addition, lubricating oil tends to be scattered toward the outer side in the radial direction because of a centrifugal force generated during rotation of the vane 4. Therefore, lubricating oil tends to reside in the lower portion of the pump chamber A (around the inner peripheral surface of the peripheral wall portion 200).

(Suction Section AU and Discharge Section AD)

As illustrated in FIG. 2, a position (angle about the rotational axis X) at which the sliding direction of the vane 4 with respect to the rotor 3 is inverted from outward (projecting side) in the radial direction (about the rotational axis X) to inward (retracting side) is defined as a reference position θ1. In addition, a straight line that passes through the reference position θ1 and the rotational axis X is defined as a division line B. As seen from the front side, the division line B includes a short axis of the elliptical shape of the pump chamber A (inner peripheral surface of the peripheral wall portion 200). As indicated by the upward sloping dotted hatching lines in FIG. 2, a section of the pump chamber A on the upper side with respect to the division line B (a section on the suction hole 200*a* side with respect to the reference position θ1, for which the capacity of the working chamber A2 on the rear side of the vane 4 in the rotational direction becomes larger along with rotation of the rotor 3 when the rotor 3 is rotated in the forward rotation direction Y) is defined as the suction section AU. As indicated by the downward sloping dotted hatching lines in FIG. 2, meanwhile, a section of the pump chamber A on the lower side with respect to the division line B (a section on the discharge hole 201*a* side with respect to the reference position θ1, for which the capacity of the working chamber A1 on the front side of the vane 4 in the rotational direction becomes smaller along with rotation of the rotor 3 when the rotor 3 is rotated in the forward rotation direction Y) is defined as the discharge section AD. The suction hole 200*a* is disposed in a portion of the peripheral wall portion 200 corresponding to the suction section AU. On the other hand, the discharge hole 201*a* and the pressure relief groove 201*b* are disposed in a portion of the bottom wall portion 201 corresponding to the discharge section AD.

(Pressure Relief Groove 201*b*)

As illustrated in FIGS. 1 and 2, the pressure relief groove 201*b* is provided to be recessed in the front surface (inner surface) of the bottom wall portion 201. A clearance (clearance in the radial direction about the rotational axis X) E is secured between the pressure relief groove 201*b* and the inner peripheral surface (inner surface) of the peripheral wall portion 200 over the entire length of the pressure relief groove 201*b*. That is, the pressure relief groove 201*b* is located on the inner side in the radial direction (upper side) away from the inner peripheral surface of the peripheral wall portion 200 by an amount corresponding to the clearance E. In addition, the pressure relief groove 201*b* is disposed on the inner side in the radial direction (upper side) with respect to the liquid surface of lubricating oil in the pump chamber A (e.g. the liquid surface of a residing portion of lubricating oil formed in the lower portion of the pump chamber A, and the liquid surface of lubricating oil splashed by the vane 4 from the residing portion toward the discharge hole 201*a*). The pressure relief groove 201*b* extends in the circumferential direction of the rotor 3 (circumferential direction about the rotational axis X). A groove front end (an end on the front side in the forward rotation direction Y of the rotor 3) 201*bb* of the pressure relief groove 201*b* is continuous with the discharge hole 201*a*.

An angle about the rotational axis X of the rotor 3 is defined as a center angle. In addition, the center angle of the reference position θ1 is defined as 0°. The center angle is advanced in the forward rotation direction Y of the rotor 3. The center, in the groove width direction, of a groove rear end (an end on the rear side in the forward rotation direction Y of the rotor 3) 201*ba* of the pressure relief groove 201*b* is set to a position at a center angle of 70°. On the other hand, the center, in the groove width direction, of the groove front end 201*bb* of the pressure relief groove 201*b* is set to a position at a center angle of 115°. The sectional shape (sectional shape in a direction that is orthogonal to the extension direction) of the pressure relief groove 201*b* has a trapezoidal shape. A groove width F1 of the pressure relief groove 201*b* on the front side (opening side) is 3 mm. A groove width F2 of the pressure relief groove 201*b* on the rear side (bottom surface side) is 1.8 mm. A groove depth G of the pressure relief groove 201*b* is 1 mm.

[Operation of Vane Pump]

Next, operation of the vane pump according to the present embodiment will be described. When the vane pump 1 is driven, as illustrated in FIG. 2, the rotor 3 and the vane 4 are rotated in the forward rotation direction Y. At a predetermined rotational angle, as illustrated in FIG. 1, the oil passages L1 and L2 are open. The capacities of the plurality of working chambers A1 and A2 illustrated in FIG. 2 are varied to be increase and decrease along with rotation of the vane 4. Along with rotation of the rotor 3, the capacity of the working chamber A2 on the rear side of the vane 4 in the rotational direction (particularly, one end 4*a* of the vane 4 in the longitudinal direction; the same applies hereinafter) gradually becomes larger. Therefore, air is suctioned from the brake booster into the working chamber A2 via the suction hole 200*a*. Along with rotation of the rotor 3, on the other hand, the capacity of the working chamber A1 on the front side of the vane 4 in the rotational direction gradually becomes smaller. Therefore, the internal pressure of the working chamber A1 is raised. Thus, the valve 50 of the reed valve 5 illustrated in FIG. 4 receives the internal pressure of the working chamber A1 from the front side (inner side), and the pressure of the outside (internal space of the chain cover) from the rear side (outer side).

When the internal pressure of the working chamber A1 becomes more than the pressure from the outside and the elastic force of the valve 50 illustrated in FIG. 4, the valve 50 is switched from the valve-closed state to the valve-open state. Therefore, air is discharged from the working chamber A1 to the outside via the discharge hole 201*a*. Besides, lubricating oil supplied from the oil passages L1 and L2 to the pump chamber A is also discharged from the working chamber A1 to the outside via the discharge hole 201*a*. When the internal pressure of the working chamber A1 becomes less than the pressure from the outside and the elastic force of the valve 50 because of discharge of air and lubricating oil, the valve 50 is switched from the valve-open state to the valve-closed state again. In this manner, the reed valve 5 opens the discharge hole 201*a* intermittently.

Figure 5:
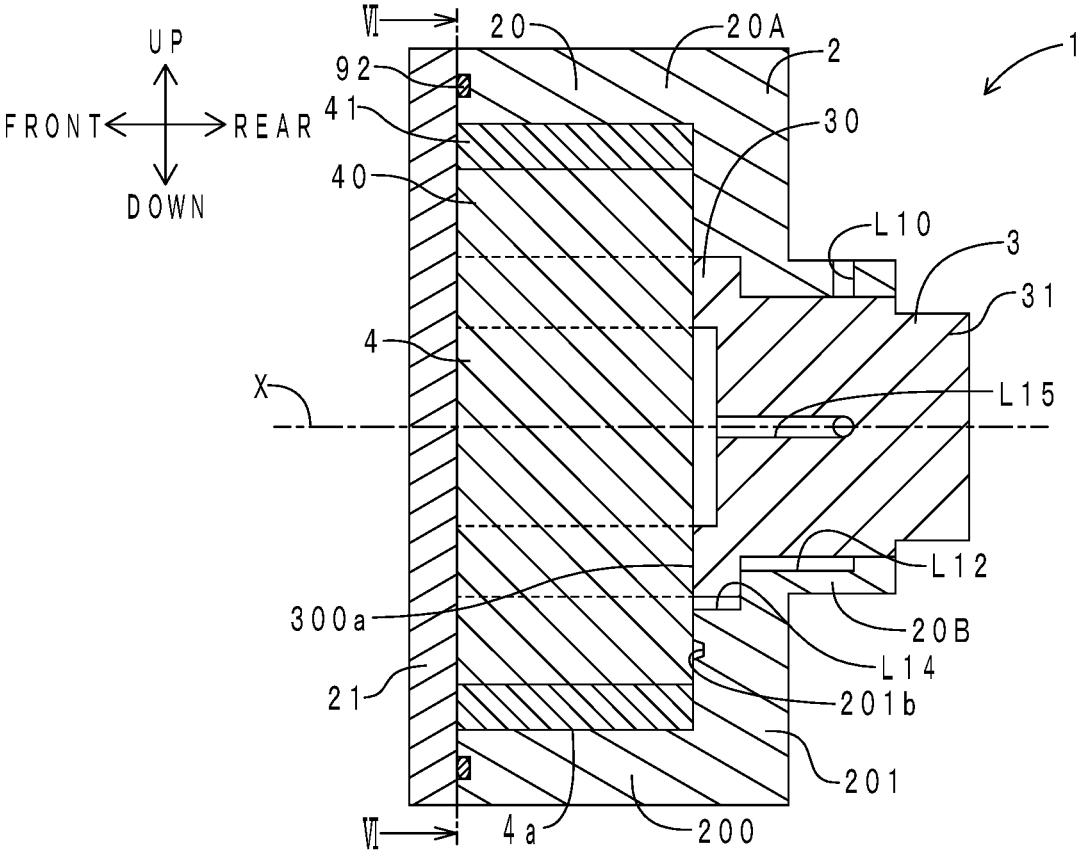
FIG. 5 is an axial sectional view of the vane pump at the time when a vane overlaps a pressure relief groove.
Figure 6:
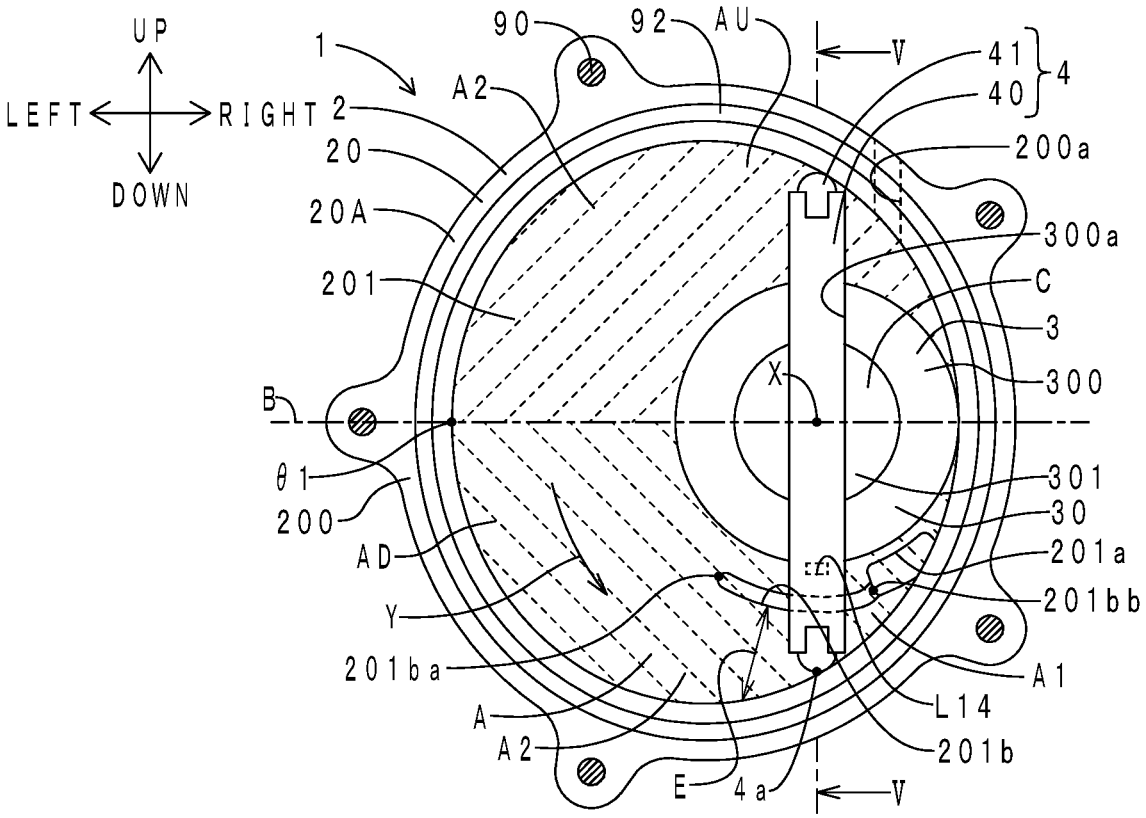
FIG. 6 is a cross-sectional view taken along the VI-VI direction of FIG. 5.

FIG. 5 is an axial sectional view of the vane pump according to the present embodiment at the time when the vane overlaps the pressure relief groove. FIG. 6 is a cross-sectional view taken along the VI-VI direction of FIG. 5. FIG. 5 corresponds to a section taken along the V-V direction of FIG. 6. When the vane pump 1 is driven, as illustrated in FIGS. 5 and 6, the vane 4 passes in the forward rotation direction Y on the front side of the pressure relief groove 201*b*. Air and lubricating oil in the working chamber A1 on the front side of the vane 4 in the rotational direction flow toward the discharge hole 201*a* while being pushed by the vane 4.

When the vane 4 passes on the front side of the pressure relief groove 201*b*, the working chamber A1 on the front side (high pressure side) of the vane 4 in the rotational direction and the working chamber A2 on the rear side (low pressure side) of the vane 4 in the rotational direction communicate with each other via the pressure relief groove 201*b*. Lubricating oil has a higher specific gravity than that of air. Therefore, lubricating oil tends to flow toward the lower side with respect to air because of the gravitational force. Besides, lubricating oil tends to be scattered toward the outer side in the radial direction compared to air because of a centrifugal force generated during rotation of the vane 4. Thus, lubricating oil tends to reside in the lower portion of the pump chamber A (around the inner peripheral surface of the peripheral wall portion 200). Alternatively, lubricating oil tends to flow along the inner peripheral surface of the peripheral wall portion 200. On the other hand, air tends to flow toward the upper side (inner side in the radial direction) with respect to lubricating oil. In this respect, the clearance E is secured between the pressure relief groove 201*b* and the inner peripheral surface of the peripheral wall portion 200. Therefore, a part of air in the working chamber A1 internally leaks to the working chamber A2 by way of the pressure relief groove 201*b*. On the other hand, lubricating oil in the working chamber A1 is not likely to flow into the working chamber A2 by way of the pressure relief groove 201*b*.

Function and Effect

Next, the function and effect of the vane pump according to the present embodiment will be described. As illustrated in FIG. 6, the length of the pressure relief groove 201*b* in the circumferential direction (rotational direction of the vane 4) is larger than the width of the vane 4 in the circumferential direction. As illustrated in FIGS. 5 and 6, when the vane 4 overlaps the pressure relief groove 201*b* during forward rotation of the rotor 3, a pair of working chambers A1 and A2 on both sides of the vane 4 in the rotational direction communicate with each other via the pressure relief groove 201*b* while bypassing the vane 4. Therefore, a part of air can be caused to internally leak from the working chamber A1 on the front side in the rotational direction (high pressure side) to the working chamber A2 on the rear side in the rotational direction (low pressure side). Thus, the amount of air in the working chamber A1 on the front side in the rotational direction can be reduced. In other words, it is possible to suppress the internal pressure of the working chamber A1 on the front side in the rotational direction becoming excessively high. Hence, with the vane pump 1 according to the present embodiment, abrupt opening of the reed valve 5 can be suppressed.

The pressure relief groove 201*b* is disposed in the front surface of the bottom wall portion 201. In addition, the clearance E is secured between the pressure relief groove 201*b* and the inner peripheral surface of the peripheral wall portion 200. Further, the pressure relief groove 201*b* is disposed on the upper side with respect to the liquid surface of lubricating oil in the pump chamber A. Therefore, air which has a low specific gravity can be introduced into the pressure relief groove 201*b* in preference to lubricating oil which has a high specific gravity in the working chamber A1. Thus, the amount of air can be reduced in preference to lubricating oil.

Figure 7:
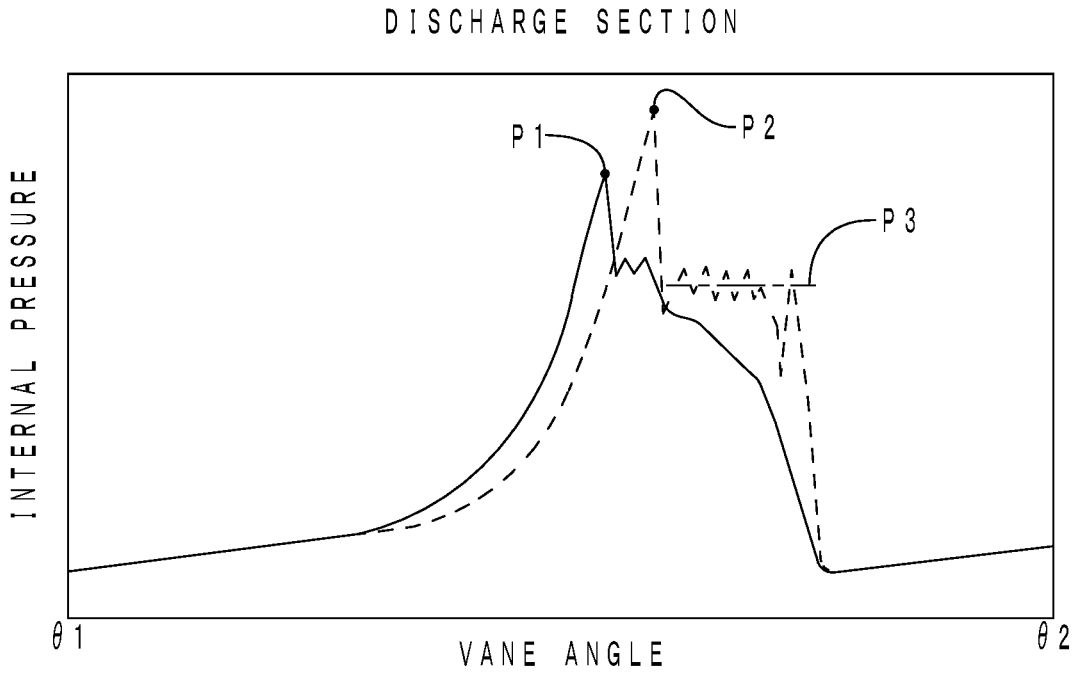
FIG. 7 is a schematic chart illustrating variations in internal pressure of a working chamber of the vane pump.

FIG. 7 is a schematic chart illustrating variations in internal pressure of the working chamber of the vane pump according to the present embodiment. It should be noted, however, that FIG. 7 is a schematic chart and the actual variations in internal pressure may differ from those in FIG. 7. The dotted line indicates variations in internal pressure with the vane pump according to the related art (vane pump without the pressure relief groove 201*b*). The horizontal axis represents the vane angle as the rotational angle of the one end 4*a* of the vane 4 (center angle about the rotational axis X of the rotor 3) as illustrated in FIGS. 2 and 6. Meanwhile, the vertical axis represents the internal pressure of the working chamber A1 indicated in FIGS. 2 and 6.

As illustrated in FIG. 7, the internal pressure of the working chamber A1 becomes higher as the vane 4 is rotated. In the case of the vane pump according to the related art, as indicated by the dotted line, the internal pressure of the working chamber A1 is raised to a peak value (peak pressure) P2. When the internal pressure is raised to the peak value P2, the reed valve 5 illustrated in FIG. 4 opens abruptly. Therefore, air and lubricating oil in the working chamber A1 are discharged to the outside via the discharge hole 201*a*. In the case of the vane pump according to the related art, the gas-to-liquid ratio (=amount of air/amount of lubricating oil) in the working chamber A1 is high compared to the vane pump 1 according to the present embodiment to be discussed later. Therefore, during discharge, first, air is mainly discharged. Along with discharge of air, the internal pressure is immediately lowered from the peak value P2. Subsequently, lubricating oil is mainly discharged. In this event, however, the internal pressure is lower than the peak value P2. Therefore, lubricating oil is not easily discharged. Thus, along with discharge of lubricating oil, the internal pressure hunts (fluctuates up and down) around a plateau value P3 that is less than the peak value P2. When lubricating oil is completely discharged, the internal pressure is further lowered. Then, the reed valve 5 illustrated in FIG. 4 closes. In this manner, in the case of the vane pump according to the related art, the peak value P2 of the internal pressure is high. Besides, the internal pressure is not easily lowered when the valve opens. Therefore, vibration or noise tends to be generated with members (such as the chain cover, a belt cover, and a cylinder head cover, for example) that are adjacent to the vane pump.

In contrast, in the case of the vane pump 1 according to the present embodiment, as indicated by the solid line, the working chamber A1 and the working chamber A2 communicate with each other via the pressure relief groove 201*b* in a predetermined rotational angle section (see FIG. 6). In addition, the pressure relief groove 201*b* is located away from the inner peripheral surface of the peripheral wall portion 200 by an amount corresponding to the clearance E. Therefore, a part of air internally leaks from the working chamber A1 to the working chamber A2 via the pressure relief groove 201*b*. Thus, the internal pressure of the working chamber A1 is raised to the peak value (peak pressure) P1. It should be noted, however, that the peak value P1 is smaller than the peak value P2 since a part of air in the working chamber A1 internally leaks. When the internal pressure is raised to the peak value P1, the reed valve 5 illustrated in FIG. 4 opens. Therefore, air and lubricating oil in the working chamber A1 are discharged to the outside via the discharge hole 201*a*. In the case of the vane pump 1 according to the present embodiment, the gas-to-liquid ratio in the working chamber A1 is lower than that with the vane pump according to the related art by an amount corresponding to the part of air which internally leaks. Therefore, during discharge, air and lubricating oil tend to be discharged at a time. Thus, the internal pressure is immediately lowered from the peak value P1. In addition, the internal pressure is not likely to hunt. When air and lubricating oil are completely discharged, the reed valve 5 illustrated in FIG. 4 closes.

In this manner, in the case of the vane pump 1 according to the present embodiment, the peak value P1 of the internal pressure is low. Besides, the internal pressure is easily lowered when the valve opens. Therefore, vibration or noise is not likely to be generated with members (such as the chain cover, the belt cover, and the cylinder head cover, for example) that are adjacent to the vane pump. In addition, air which is a compressible fluid mainly flows in the pressure relief groove 201*b*. Therefore, vibration or noise is not likely to be generated along with the flow.

As illustrated in FIG. 2, in addition, the groove rear end 201*ba* of the pressure relief groove 201*b* is set to a position at a center angle of less than 90° (position at a center angle of 70°). On the other hand, the groove front end 201*bb* of the pressure relief groove 201*b* is set to a position at a center angle of more than 90° (position at a center angle of 115°). In this manner, the pressure relief groove 201*b* extends between both sides in the rotational direction with reference to a position directly below the rotational axis X (position at a center angle of 90°). Therefore, the groove front end 201*bb* and the groove rear end 201*ba* are not likely to be blocked by lubricating oil. Thus, lubricating oil is not likely to be accumulated in the pressure relief groove 201*b*.

In addition, the groove front end 201*bb* of the pressure relief groove 201*b* is continuous with the discharge hole 201*a*. Therefore, a part of air can be caused to internally leak from the working chamber A1 to the working chamber A2 until immediately before the valve 50 illustrated in FIG. 4 is switched from the valve-closed state to the valve-open state, and even after such switching.

In addition, as illustrated in FIG. 1, the pressure relief groove 201*b* has a trapezoidal sectional shape. Besides, the groove width F1 of the pressure relief groove 201*b* on the front side (opening side) is larger than the groove width F2 of the pressure relief groove 201*b* on the rear side (bottom surface side). Therefore, a groove side surface of the pressure relief groove 201*b* on the outer side in the radial direction (lower side in FIG. 1) is set to be inclined downward from the upper rear side (inner side in the radial direction, and the side opposite to the pump chamber A) toward the lower front side (outer side in the radial direction, and the side of the pump chamber A). Thus, lubricating oil that has flowed into the pressure relief groove 201*b* can be immediately discharged out of the groove because of a centrifugal force generated during rotation of the vane 4 and the weight of the lubricating oil itself.

Second Embodiment

Figure 8:
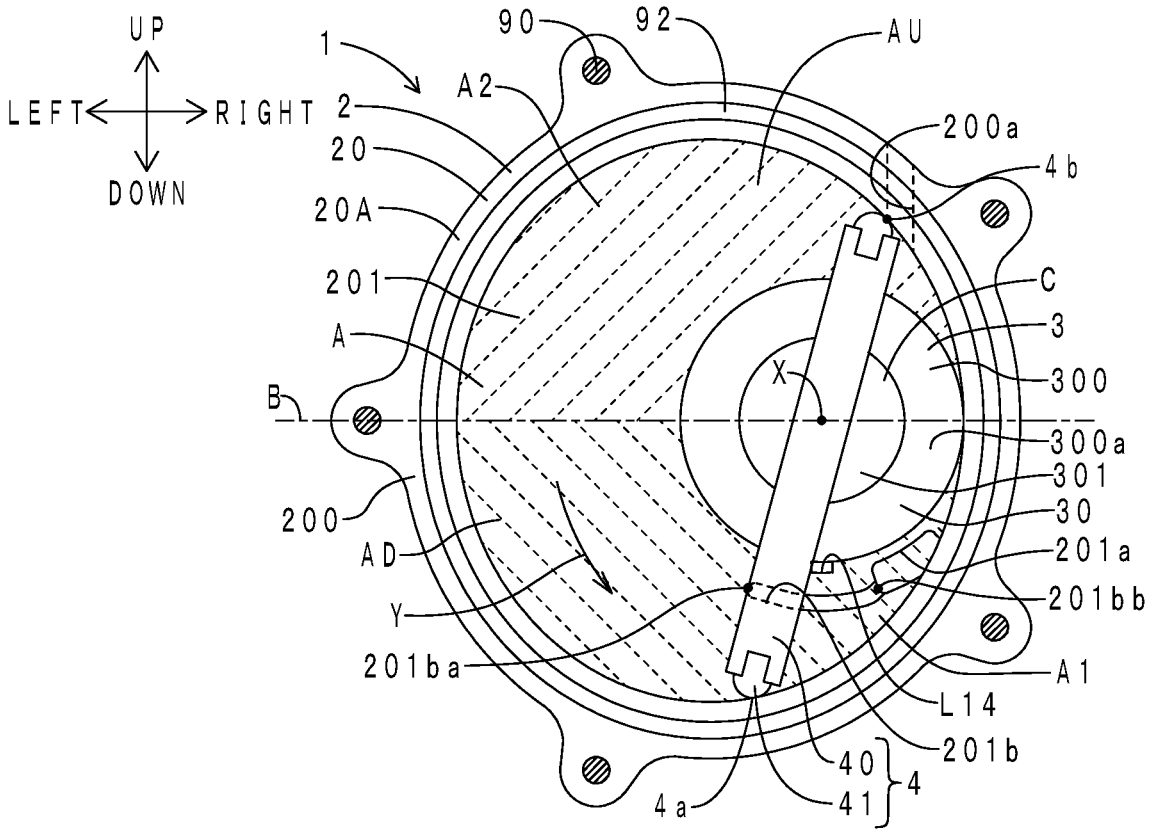
FIG. 8 is a radial sectional view, as seen from the front side, of a vane pump according to a second embodiment at the time when a vane overlaps a pressure relief groove.

A vane pump according to the present embodiment and the vane pump according to the first embodiment differ from each other in position of the groove rear end of the pressure relief groove. Only such a difference will be described below. FIG. 8 is a radial sectional view, as seen from the front side, of the vane pump according to the present embodiment at the time when the vane overlaps the pressure relief groove. Members corresponding to those in FIG. 2 are denoted by the same reference numerals.

FIG. 8 illustrates a state immediately before a pair of working chambers A1 and A2 on both sides, in the rotational direction, of the one end 4*a* of the vane 4 in the longitudinal direction communicate with each other via the pressure relief groove 201*b* while bypassing the one end 4*a* of the vane 4 during forward rotation of the rotor 3. The groove rear end 201*ba* is covered by the vane body 40 from the front side. In this state, the other end 4*b* (particularly, a sliding portion between the other end 4*b* and the inner peripheral surface of the peripheral wall portion 200) of the vane 4 in the longitudinal direction has already passed the suction hole 200*a*. Therefore, the working chamber A2 is isolated from the suction hole 200*a* by the other end 4*b* of the vane 4.

The vane pump 1 according to the present embodiment and the vane pump according to the first embodiment have the same function and effect for common configurations. In the vane pump 1 according to the present embodiment, the groove rear end 201*ba* is disposed such that a pair of working chambers A1 and A2 on both sides, in the rotational direction, of the one end 4*a* of the vane 4 communicate with each other via the pressure relief groove 201*b* after the other end 4*b* of the vane 4 passes the suction hole 200*a* during forward rotation of the rotor 3. Therefore, the working chamber A2 does not communicate with the suction hole 200*a* when the pair of working chambers A1 and A2 communicate with each other via the pressure relief groove 201*b*. Thus, the suction capability of the vane pump 1 is not easily reduced.

<Others>

The vane pumps according to the embodiments of the present invention have been described above. However, the present invention is not specifically limited to the embodiments described above. The present invention can be implemented with a variety of modifications and alterations that may be achieved by a person skilled in the art.

The type of the compressible fluid (gas, working fluid) which is housed in the pump chamber A is not specifically limited. For example, the compressible fluid may be oxygen, hydrogen, nitrogen, or the like. In addition, the type of the incompressible fluid (liquid, lubricating agent) is also not specifically limited.

The position of the groove front end 201*bb* of the pressure relief groove 201*b* is not specifically limited. The groove front end 201*bb* may not be continuous with the discharge hole 201*a*. The position of the groove rear end 201*ba* of the pressure relief groove 201*b* is not specifically limited. The groove rear end 201*ba* may be disposed in the suction section AU. It is only necessary that at least a part of the pressure relief groove 201*b* should be disposed in the discharge section AD.

The shape of the pressure relief groove 201*b* in the extension direction is not specifically limited. The pressure relief groove 201*b* may have the shape of a partial arc about the rotational axis X, a straight line, a curve, or a combination of such shapes as seen from the front side. The pressure relief groove 201*b* may be branched at the middle thereof. The pressure relief groove 201*b* may have a Y-shape, an X-shape, an E-shape, or the like as seen from the front side. The extension direction of the pressure relief groove 201*b* may contain at least a component in a "circumferential direction about the rotational axis X". A plurality of pressure relief grooves 201*b* may be provided side by side in the circumferential direction or the radial direction about the rotational axis X.

The cross-sectional shape of the pressure relief groove 201*b* is not specifically limited. The cross section of the pressure relief groove 201*b* may have a C-shape, a semi-circular shape, a U-shape, a polygonal shape (triangular shape, quadrangular shape), or the like. The pressure relief groove 201*b* may have different cross-sectional shapes or the same cross-sectional shape over the entire length thereof. The cross-sectional shape of the pressure relief groove 201*b* may be varied at the middle in the extension direction thereof. The cross-sectional area of the pressure relief groove 201*b* is not specifically limited. The pressure relief groove 201*b* may have different cross-sectional areas or the same cross-sectional area over the entire length thereof. The cross-sectional area of the pressure relief groove 201*b* may be varied at the middle in the extension direction thereof. The amount of internal leakage of air that flows from the working chamber A1 to the working chamber A2 can be adjusted by adjusting the cross-sectional area of the pressure relief groove 201*b*. Therefore, the rising speed of the internal pressure indicated in FIG. 7 can be adjusted. In addition, the peak value P1 of the pressure can be adjusted. In addition, the drive torque and the suction capability of the vane pump 1 can be adjusted.

In addition, lubricating oil tends to flow along the inner peripheral surface of the peripheral wall portion 200. In other words, lubricating oil tends to flow in a portion that the caps 41 of the vane 4 pass. With a focus on this respect, the pressure relief groove 201*b* may be disposed so as not to overlap a portion that the caps 41 pass as seen from the front side. Specifically, as illustrated in FIG. 2, the clearance E is smallest around the groove front end 201*bb*, of the overall length of the pressure relief groove 201*b*. That is, a smallest portion E1 of the clearance E is set between the groove front end 201*bb* and the inner peripheral surface of the peripheral wall portion 200. The smallest portion E1 may be set to be larger than an amount of projection D of the caps 41 with respect to the vane body 40 in the radial direction as seen from the front side. With this configuration, lubricating oil is not likely to flow into the pressure relief groove 201*b*.

A path for introducing lubricating oil into the oil passages L1 and L2 is not specifically limited. For example, an oil hole inside the camshaft and the oil hole L11 inside the shaft portion 31 may be coupled to each other by an oil supply pipe (coupling member). That is, lubricating oil may be introduced from the camshaft into the oil passages L1 and L2 via the oil supply pipe.

The type of the vane pump 1 is not specifically limited. For example, a plurality of vanes 4 may be disposed radially for a single rotor 3. In addition, a plurality of pump chambers A may be defined in a single vane pump 1. The pump chamber A may not have an elliptical shape as seen from the front side. For example, the pump chamber A may have an oval shape (a shape obtained by connecting both ends of a pair of semi-circles that face each other with their openings directed inward using a pair of straight lines). The drive source of the vane pump 1 is not specifically limited. For example, the drive source may be a motor or the like. That is, the vane pump according to the present invention may be implemented as an electric vane pump.

The axial direction of the vane pump 1 is not specifically limited. For example, the axial direction may be the up-down direction, a direction that intersects the up-down direction and the horizontal direction, or the like. Also in this case, air flows on the inner side in the radial direction with respect to lubricating oil because of a centrifugal force generated along with rotation of the vane 4. Therefore, air can be preferentially caused to internally leak from the working chamber A1 to the working chamber A2 via the pressure relief groove 201*b*.

DESCRIPTION OF THE REFERENCE NUMERALS

1 VANE PUMP
2 HOUSING
3 ROTOR
4 VANE
4*a* ONE END
4*b* OTHER END
5 REED VALVE
20 HOUSING BODY
20A PUMP PORTION
20B TUBULAR PORTION
21 END PLATE
30 ROTOR BODY
31 SHAFT PORTION
40 VANE BODY
41 CAP
52 VALVE
51 STOPPER
52 BOLT
90 BOLT
90 NUT
92 O-RING
200 PERIPHERAL WALL PORTION
200*a* SUCTION HOLE
201 BOTTOM WALL PORTION
201*a* DISCHARGE HOLE
201*b* PRESSURE RELIEF GROOVE
201*b*a GROOVE REAR END
201*bb* GROOVE FRONT END
300 PERIPHERAL WALL PORTION
300*a* ROTOR GROOVE
301 BOTTOM WALL PORTION
500 FIXED PORTION
501 FREE PORTION
510 FIXED PORTION
511 RESTRICTION PORTION
A PUMP CHAMBER
A1 WORKING CHAMBER
A2 WORKING CHAMBER
AD DISCHARGE SECTION
AU SUCTION SECTION
B DIVISION LINE
C IN-CYLINDER SPACE
D AMOUNT OF PROJECTION
E CLEARANCE
E1 SMALLEST PORTION
F1 GROOVE WIDTH
F2 GROOVE WIDTH
G GROOVE DEPTH
L1 OIL PASSAGE
L10 OIL HOLE
L11 OIL HOLE
L12 OIL GROOVE
L13*a* OIL GROOVE
L14 OIL GROOVE
L15 OIL HOLE
L2 OIL PASSAGE
P1 PEAK VALUE
P2 PEAK VALUE
P3 PLATEAU VALUE
X ROTATIONAL AXIS
Y FORWARD ROTATION DIRECTION
θ1 REFERENCE POSITION

The invention claimed is:

1. A vane pump, comprising:

a housing that has a tubular peripheral wall portion and a bottom wall portion which is disposed at one end of the peripheral wall portion in an axial direction and in which a discharge hole is provided to open, and that defines a pump chamber communicating with the discharge hole inside the housing;

a rotor that is disposed in the pump chamber and that is rotatable about a rotational axis of the rotor;

a vane disposed so as to be slidable with respect to the rotor in a radial direction, the vane partitioning the pump chamber into a plurality of working chambers and causing capacities of the working chambers to increase and decrease along with forward rotation of the rotor; and a reed valve that opens and closes the discharge hole to allow a compressible fluid compressed in the working chambers and an incompressible fluid to be discharged intermittently, wherein a position at which a sliding direction of the vane with respect to the rotor is inverted from outward in the radial direction to inward in the radial direction during the forward rotation of the rotor is defined as a reference position;

a section of the pump chamber on a side of the discharge hole with respect to the reference position is defined as a discharge section;

a pressure relief groove is disposed in a portion of an inner surface of the bottom wall portion corresponding to the discharge section with a clearance secured between an inner surface of the peripheral wall portion and the pressure relief groove, the pressure relief groove extending in a circumferential direction about the rotational axis of the rotor; and a pair of the working chambers on both sides of the vane in a rotational direction among the plurality of working chambers communicate with each other via the pressure relief groove when the vane overlaps the pressure relief groove during the forward rotation of the rotor.

2. The vane pump according to claim 1, wherein:

an end on a front side in the rotational direction, of both ends of the pressure relief groove in an extension direction, is defined as a groove front end; and the groove front end is continuous with the discharge hole.

3. The vane pump according to claim 1, wherein:

the vane is disposed so as to be slidable with respect to the rotor in a diametrical direction;

one end and the other end of the vane in the diametrical direction are in sliding contact with the inner surface of the peripheral wall portion;

the housing is provided with a suction hole that communicates with the pump chamber;

a section of the pump chamber on a side of the suction hole with respect to the reference position is defined as a suction section;

an end on a rear side in the rotational direction, of both ends of the pressure relief groove in an extension direction, is defined as a groove rear end; and the groove rear end is disposed such that the pair of the working chambers on both sides of the vane in the rotational direction communicate with each other via the pressure relief groove on a side of the one end of the vane after the other end of the vane passes the suction hole during the forward rotation of the rotor.

* * * * *